US007614876B1

(12) United States Patent
Ward-Kubik

(10) Patent No.: US 7,614,876 B1
(45) Date of Patent: Nov. 10, 2009

(54) TWO IN ONE CANDLE

(76) Inventor: Marci S. Ward-Kubik, 6139 Bray Rd., Flint, MI (US) 48505-1806

( * ) Notice: Subject to any disclaimer, the term of this patent is extended or adjusted under 35 U.S.C. 154(b) by 481 days.

(21) Appl. No.: 11/181,193

(22) Filed: Jul. 13, 2005

Related U.S. Application Data

(60) Provisional application No. 60/588,155, filed on Jul. 15, 2004.

(51) Int. Cl.
*F23D 13/00* (2006.01)

(52) U.S. Cl. ..... 431/289; 431/291; 431/295; 431/297; 431/324; 248/511; 248/512; 248/519; D26/9; D26/13; D26/22

(58) Field of Classification Search ..... 431/289, 431/291, 295, 297, 324, 321, 298, 126; 248/511, 248/512, 519, 529; D26/9, 13, 22
See application file for complete search history.

(56) References Cited

U.S. PATENT DOCUMENTS

| | | | | |
|---|---|---|---|---|
| 2,274,823 | A * | 3/1942 | Candy, Jr. | 264/279 |
| 3,743,473 | A * | 7/1973 | Von Suskil | 431/297 |
| 6,120,283 | A * | 9/2000 | Cousins | 431/289 |
| 6,591,998 | B2 * | 7/2003 | Haynes et al. | 215/276 |
| 2002/0150854 | A1 * | 10/2002 | Riches | 431/291 |
| 2004/0240200 | A1 * | 12/2004 | Woog | 362/161 |
| 2007/0003895 | A1 * | 1/2007 | Conover | 431/289 |

* cited by examiner

*Primary Examiner*—Steven B McAllister
*Assistant Examiner*—Avinash Savani
(74) *Attorney, Agent, or Firm*—Raggio & Dinnin, P.C.

(57) ABSTRACT

A two in one candle including a bottom jar like member having a predetermined shape and size. A first candle arranged within the jar like member. A top lid which mates with an opening of the jar like member when the candle is closed. A second candle arranged within the lid.

20 Claims, 1 Drawing Sheet

TWO IN ONE CANDLE

This application claims the benefit of provisional application 60/588,155 filed Jul. 15, 2004

BACKGROUND OF THE INVENTION

1. Field of the Invention

The present invention relates generally to candles and more particularly relates to a two in one candle.

2. Description of Related Art

Candles have been known for many centuries. Candles were used at one time as a light source and still are used as a light source during emergency situations where electricity is lost. In recent times candles have been used for decorative purposes including scented candles having a variety of scents and a variety of colors to add décor to a room or other setting which increases the ambiance of the room or other setting while providing a scented odor during the burning of the candle.

Candles generally are made of a wax with a wick placed along a center point of the candle. Some candles are used in candle holders wherein the candle has one end placed in the candle holder and the candle is burned from the top portion thereof. Other candles have decorative shapes such as balls, stars, or any other known shape depending on the maker of the candle and the consumer purchasing such candles. Candles have also been poured into glass jar containers. These glass jar containers may include a lid that generally has a rounded ball like top which is used to create a jar appearance when the candle is not being used. Candles have also been used in numerous other applications throughout time.

However, many of the prior art candles are only sold as single individual candles. To buy multiple candles you have to buy multiple separate candles and have separate containers for each candle and/or separate candle holders. This increases the cost and storage necessary to have multiple candles stored in one place and used in one place. Therefore, there is a need in the art for a two in one candle that can be stored in a single unit but still have the capability of having two separate candles for use by the consumer. There also is a need in the art for a two in one candle that is capable of having separate colors and scents for each of the candles in the two in one candle container.

SUMMARY OF THE INVENTION

One object of the present invention is to provide a two in one candle apparatus.

Still another object of the present invention is to provide a first candle in a container and a second candle within a lid of the container.

Still another object of the present invention is to provide a lid for a candle container that has a flat top surface which will act as a flat base portion for the second candle.

Still another object of the present invention is to provide a flat bottom lid or top for a candle container that has a predetermined depth.

Still another object of the present invention is to provide one apparatus that has two candles in the one apparatus, wherein one candle is in the bottom portion of the apparatus and a second candle is in the top portion of the apparatus.

To achieve the foregoing objects, a two in one candle is disclosed in the present invention. The candle includes a bottom container having a predetermined shaped opening with the bottom container having candle wax and a wick therein. The two in one candle also includes a lid having a cavity with a predetermined depth. The cavity having candle wax and a wick therein. The lid having a flat top surface. The lid operates as a separate candle from the bottom container by using the flat top surface as a stable base for a second candle.

One advantage of the present invention is having two candles in one container.

Another advantage of the present invention is the use of a lid having a flat top surface that operates as a separate flat base for a second candle.

Still another advantage of the present invention is having two candles stored in one container thus reducing space and cost for purchasing two candles.

Still another advantage of the present invention is that a first candle may have a predetermined color and scent while a second candle may have a second predetermined color and scent.

Other objects, features and advantages of the present invention will become apparent from the subsequent description and the appended claims, taken in conjunction with the accompanying drawings.

DESCRIPTION OF THE EMBODIMENT(S)

Figure 1:
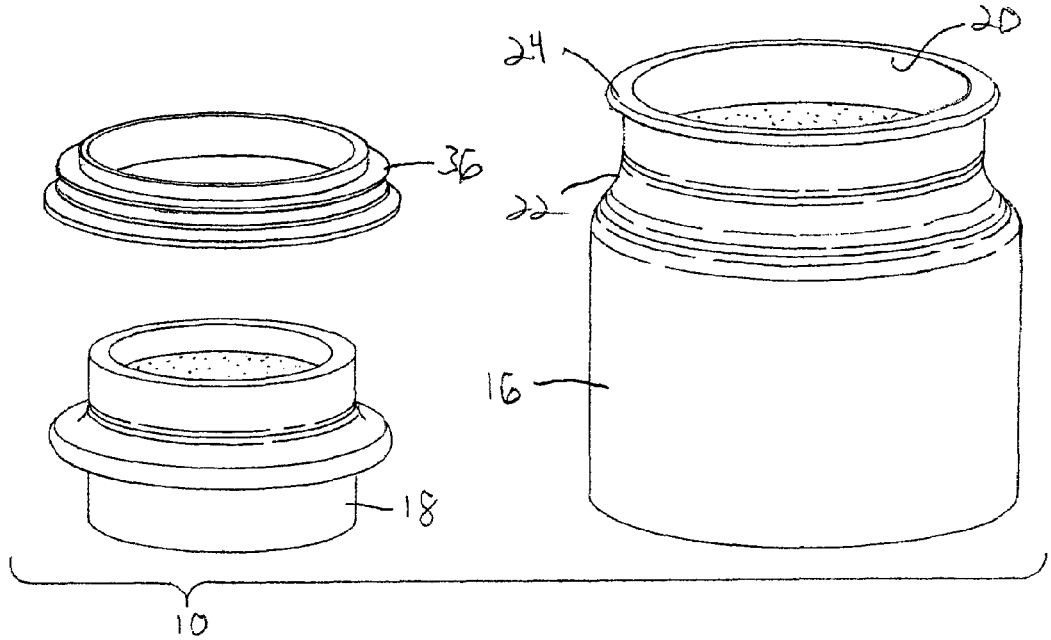
FIG. 1 shows a perspective view of a two in one candle according to the present invention.
Figure 2:
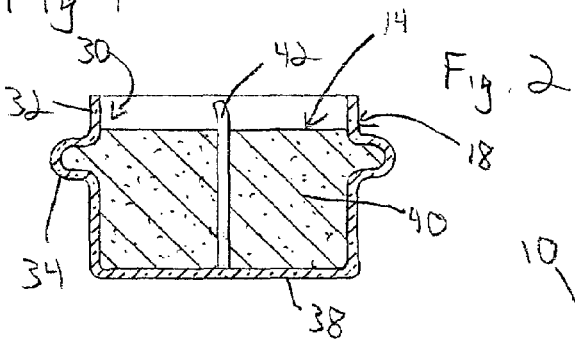
FIG. 2 shows a cross section through a top member or lid of a two in one candle according to the present invention.
Figure 3:
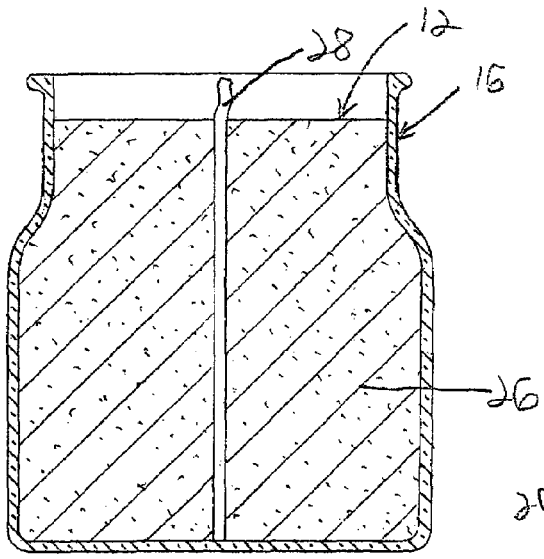
FIG. 3 shows a cross section through a bottom container or jar member according to the present invention.
Figure 4:
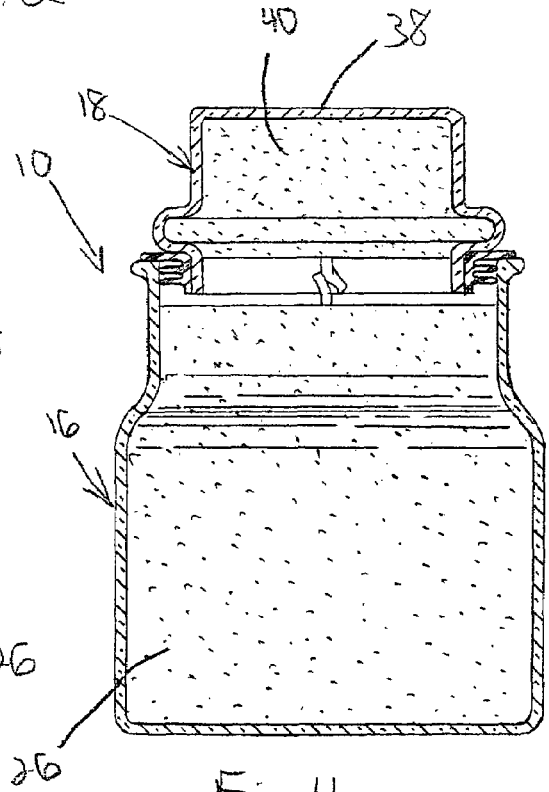
FIG. 4 shows the two in one candle in its closed or engaged position according to the present invention.

Referring to the drawings, FIGS. 1-4 show a two in one candle 10 according to the present invention. The two in one candle 10 generally includes a first 12 and second candle 14 located within a single container 10. The first candle 12 is located in the bottom portion 16 of the container 10 while the second candle 14 will be located in a top portion 18 of the container 10. It should be noted that any known color or scent may be used for the two in one candle 10. Different colors and scents or the same color and scent may be used in combination within the two in one candle 10 according to the present invention. It is even contemplated to have multi-color candles within the two in one candle 10.

Referring to FIG. 1, the two in one candle 10 includes a bottom container or jar like member 16 which has a predetermined size and shape. The bottom container 16 has an opening 20 on one end thereof. The opening 20 in the embodiment shown is generally of a circular shape. However, it should be noted that the opening 20 can be of any known shape such as but not limited to triangular, square, oval or any other known random shape. The bottom container 16 in the embodiment shown, has a reduced neck portion 22 on the end near the opening 20 of the bottom container 16. A lip 24 is arranged around the outer periphery of the bottom container 16 at the opening 20. The overall shape of the bottom container 16 is generally that of a cylindrical jar, however any other known shape may be used for the overall shape of the jar 16 depending on the design requirements of the candle maker. In the embodiment shown the bottom container 16 has candle wax 26 poured into the bottom container 16 of the two in one candle 10. A wick 28 is arranged near a center point of the bottom container 16 with the wax 26 surrounding the wick 28 in the first candle 12. The wax 26 will harden around the wick 28 and the bottom container 16 will become the first candle 12 of the two in one candle 10 according to the present invention. It should also be noted that it is contemplated to secure a pre-made candle within the bottom container 16 of the two in one candle 10.

In one embodiment the bottom container 16 of the two in one candle 10 is made of a glass material. However, it should be noted that any other ceramic, plastic, synthetic, wood, natural material, or metal may be used depending on the design requirements and heat resistivity of the materials. The bottom container 16 includes a flat bottom surface. The flat bottom surface will ensure that the first candle 12 of the two in one candle 10 will lay flat on a surface or table without any movement, rocking, or tipping. Glass is the preferred material to use for the bottom container 16 due to its heat resistive properties.

The two in one candle 10, as shown in FIG. 1, also includes a top portion or lid 18. The top portion or lid 18 generally has a round shape with any predetermined width and predetermined depth. In one embodiment the lid 18 has a two and one quarter inch diameter and a one and a half inch depth. However, it should be noted that the depth of the lid 18 may be anywhere from between ½ inch to 10 inches. The lid 18 has an opening on one end thereof. The lid 18 has a cavity or hollowed out cavity 30 which generally mimics the shape of the outer surface of the lid 18. The lid 18 also includes a flange 32 with a lip 34 extending therefrom. A seal member 36 may be placed around the flange 32 to allow for a seal to occur between the lid 18 and the bottom container 16. When in its closed position the two in one candle 10 will have a seal arranged between the lid 18 and an inner surface of the bottom container 16 at the opening 20 of the bottom container 16. The lid 18 has a flat top surface 38. The flat top surface 38 will allow for the lid 18 to be placed on a table or other surface without any movement and create a stable base for the second candle 14 of the two in one candle 10. As with the bottom container 16, as described above, a candle wax 40 is poured into the cavity 30 of the lid 18 of the two in one candle 10. A wick 42 is placed at or near a center point of the lid 18 of the two in one candle 10. Once the wax 40 hardens the lid 18 will act as a second candle 14 for the two in one candle 10. This will allow for two candles 12, 14 to be stored in one container 10 and for two separate candles to be used at the same time from the same container. The second candle 14 arranged within the lid 18 can have the same color and scent as that of the first candle 12 of the bottom container 6 or may have a different color and different scent from that of the bottom container candle 12. It should also be noted that the top candle 14 may have a multi-color effect such as that used for the bottom candle 12 depending on the design requirements of the candle maker. The top lid 18 is also made of a glass material, however any other ceramic, plastic, wood, natural material or metal may be used depending on the design requirements of the two in one candle 10.

When the two in one candle 10 is in its closed or storage position the lid 18 is secured within the opening of the bottom container 16 of the two in one candle 10. In this case the first candle 12 of the bottom container 16 will be directly opposite the second candle 14 of the lid 18. The wick 28 of the first candle 12 will extend in an upward direction while the wick 42 of the second candle 14 will extend in a downward direction towards the wick 28 of the first candle 12 when the two in one candle 10 is in its closed or storage position. When the second candle 14 in the two in one candle 10 is in its operating position the wick 42 will extend in an upward direction. It should be noted that the bottom container 16 and lid 18 can vary in size, shape and material. It should also be noted that the lid opening is generally smaller of that of the bottom container opening 20 to allow for the lid 18 to be secured within the opening of the bottom container 16. It should be noted that the seal 36 contemplated to be used on the lid 18 is generally made of a plastic material but any other composite, rubber or natural material may also be used for the seal 36.

The present invention above has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A two in one candle, said candle including:

a bottom container having a predetermined shape opening on only one end thereof, said bottom container having a candle wax poured therein and a wick arranged therein, said candle wax is permanently secured within said bottom container;

a lid having a cavity with a predetermined depth, said cavity having candle wax poured therein and a wick arranged therein, said candle wax is permanently secured within said lid; and said lid having a planar flat top surface, said lid operates as a second candle from said bottom container by using said planar flat top surface as a stable base wherein said lid is detachably secured within the opening of said bottom container.

2. The candle of claim 1 wherein said poured candle wax hardens around said wick to become one of the two candles, said bottom container having a first color wax and a first scent.

3. The candle of claim 2 wherein said lid having said first color wax and said first scent.

4. The candle of claim 2 wherein said lid having a second color wax and a second scent.

5. The candle of claim 1 wherein said lid has a predetermined shape opening that is substantially the same shape as said opening of said bottom container, said lid opening is smaller than said bottom container opening, said bottom container having a planar flat bottom surface.

6. The candle of claim 5 wherein said openings having a circular, square, triangular or, oval shaped.

7. The candle of claim 1 wherein said lid having a seal arranged around an end thereof.

8. The candle of claim 7 wherein said seal contacts said bottom container when said lid is engaged with said bottom container.

9. The candle of claim 1 wherein said wick of said bottom container extends in an upward direction, said wick of said lid extends toward said wick of said bottom container in a downward direction when said lid is arranged in a closed position on said bottom container.

10. The candle of claim 9 wherein said wick of said lid extends in an upward direction when said lid is used as said second candle.

11. The candle of claim 1 wherein said container and said lid are made of glass, said depth of said cavity is within the range of one inch to three inches.

12. A two in one candle assembly, said candle assembly including:

a bottom jar like member having a predetermined shape and size, said jar like member having an opening on only one end thereof, said jar like member having a planar flat bottom surface;

a first candle is poured into and permanently secured completely within said jar like member;

a lid which mates with said opening of said jar like member is removably secured when the candle is closed; and a second candle is poured into and permanently secured completely within said lid.

13. The candle assembly of claim 12 wherein said lid having a cavity with a predetermined depth wherein said depth is approximately one to three inches, said second candle is arranged within said cavity.

14. The candle assembly of claim 12 wherein said first candle and said second candle having the same color and scent.

15. The candle assembly of claim 12 wherein said first candle having a first color and a first scent, said second candle having a second color and a second scent.

16. The candle assembly of claim 12 wherein said jar and said lid are made of glass.

17. The candle assembly of claim 12 wherein said lid having a flat top surface, said flat top surface acts as a base for said second candle.

18. The candle assembly of claim 12 wherein said opening having a circular, square or, triangular shaped.

19. The candle assembly of claim 12 wherein said lid having a seal arranged on one end thereof.

20. The candle assembly of claim 12 wherein said first candle is directly opposite said second candle when said lid is engaged with said jar like member in said closed position.

* * * * *